US007014595B2

(12) United States Patent
Bruno

(10) Patent No.: US 7,014,595 B2
(45) Date of Patent: Mar. 21, 2006

(54) ICE SKATING TRAINING APPARATUS FOR PLAYING HOCKEY

(76) Inventor: John M Bruno, 86 Oak St., Walpole, MA (US) 02081

( * ) Notice: Subject to any disclaimer, the term of this patent is extended or adjusted under 35 U.S.C. 154(b) by 0 days.

(21) Appl. No.: 10/683,940

(22) Filed: Oct. 10, 2003

(65) Prior Publication Data

US 2005/0079956 A1 Apr. 14, 2005

(51) Int. Cl.
*A63B 22/00* (2006.01)

(52) U.S. Cl. ..... 482/51; 482/70

(58) Field of Classification Search ..... 482/51, 482/70, 120, 148, 908, 71, 79, 80, 114, 116; 601/29–34; 434/255
See application file for complete search history.

(56) References Cited

U.S. PATENT DOCUMENTS 4,781,372 A * 11/1988 McCormack ..... 482/70
4,911,430 A * 3/1990 Flament ..... 482/71
4,915,373 A * 4/1990 Walker ..... 482/51
5,643,162 A * 7/1997 Landers et al. ..... 482/131
5,911,650 A * 6/1999 Cox ..... 482/70
6,042,511 A * 3/2000 Bulloch ..... 482/51
6,106,442 A * 8/2000 Tissue ..... 482/71
6,786,850 B1 * 9/2004 Nizamuddin ..... 482/51
2004/0132582 A1 * 7/2004 Park et al. ..... 482/51

* cited by examiner

*Primary Examiner*—Stephen R. Crow
*Assistant Examiner*—Tam Nguyen
(74) *Attorney, Agent, or Firm*—Gregory Butler, Esq.

(57) ABSTRACT

The present invention relates to an ice skating exercise apparatus which includes a pair of movable pedal assemblies which are adapted to provide a user with an exercise workout which simulates an athlete's movement when ice skating. The apparatus is a free standing unit and includes a horizontal platform, two defined curvature stride paths, respective pedal assemblies for the right and left feet, a variable resistance mechanism, a handle assembly and a chest support.

6 Claims, 5 Drawing Sheets

ICE SKATING TRAINING APPARATUS FOR PLAYING HOCKEY

FIELD OF THE INVENTION

The present invention relates to an exercise apparatus adapted to replicate the true ice skating motion of an individual playing hockey, whereby the user's legs move in symetrical, inward and outward curvature motions.

BACKGROUND OF THE INVENTION

No matter which position you play in hockey, winning the one-on-one battles is one of the most important individual contributions you can make for your team. To win those battles, you need to be able to read the play around you and, more importantly, be physically strong on your skates.

Physical strength on your skates is very important for winning face-offs, positioning yourself in front of your opponents net, controlling the puck along the boards or in close proximity to a defender, and defending your crease (this is true for both goaltenders and defensemen). Muscular strength also protects you from injury and will help you heal quicker if you do get injured. Strong legs are important for powerful skating strides, starting, turning and stopping. In addition, leg strength contributes to a potent slap shot. Building strong leg muscles also lowers your center of gravity, assisting your balance and stability, thereby making it easier to battle past an opponent to get toward the net.

Muscular strength is your ability to exert maximal force (using maximum or near maximum resistance) during limited repetitions. When focusing on strength improvements, you are generally working to increase your power and muscle mass. Muscular endurance is your ability to exert sub-maxima (using less than maximum resistance) during repeated repetitions. When focusing on endurance improvements, you are generally working to increase your muscle's ability to work over a period of time. Both stength and endurance in leg muscles are critically important for maximizing ice skating performance while playing hockey.

Exercise apparatus which simulate walking, running and stair climbing are well known. Running and walking exercise apparatus typically comprise an inclined moving belt or treadmill upon which the user walks or runs. Stair climbing or stepping apparatus typically include a pair of hinged pedals upon which a user stands, and in which the pedals are moved up and down by the user shifting his or her weight to simulate stair climbing movement. While conventional exercise apparatus achieve the exercise and movement of the biceps femoris muscle, they are poorly suited to provide toning and exercise the remaining leg muscles used in ice skating, such as abductors and adductor muscles, the gastrocnemius muscle, the soleusmuscle the gracilis muscle and/or the sartorius muscle.

Prior art efforts to provide devices adapted to training ice skaters have included the following:

Schutzer, U.S. Pat. No. 4,340,214 describes a training apparatus for skaters consisting of a fixed training stand with two carriages transversely displaceable in opposite directions, the displacement of which is controlled. Each carriage has a platform for the attachment of one of the skater's feet, said platform altering its angle of inclination upon displacement of the associated carriage from the initial position in the same way as a skate when cutting the ice. The lateral displacement of each carriage occurs against the action of a force which is adjustable.

McCormack, U.S. Pat. No. 4,781,372 describes an ice-skating leg exercise device utilizing in one embodiment a pair of rotatably positionable tracks each having a stirrup movable back and forth thereon in which the user's legs are positioned, each track being angularly adjustable with adjustable weight resistance provided against the rearward movement of each stirrup and a body support for the user to rest there against while exercising his legs on the device.

Colombo, U.S. Pat. No. 4,869,496 describes a piece of equipment for the simulation of skiing movements which comprises a basic structure which can be stably placed on the ground. An arm is hinged to the basic structure in a median position and is able to oscillate horizontally. The arm carries a pair of boards at its end. Feet are connected to the structure to incline it with respect to the ground. The arm is able to carry out a slight vertical oscillation. The boards are restrained to the arm so that they can rotate around their vertical and horizontal axes, the rotation around the vertical axis being limited by suitable means. Two rods overhang and are connected to the arm by pins. The rods are able to rotate around the vertical axis of these pins, such rotation being made synchronous with that of the boards. The rotation is opposite to the direction of oscillation of the arm. The piece of equipment is also equipped with an electrical detection circuit which detects correct or incorrect movements carried out by the user who, by placing his or her feet on the boards and gripping the rods, gives an oscillating movement to the arm with the help of elastic devices which absorb and give back the kinetic energy produced, thus carrying out the movements required by skiing techniques.

Walker, U.S. Pat. No. 4,915,373 describes a power skating exercise device includes a pair of endless guide tracks, each of which have a power section and a return section and a pedal for each guide track. The pedal is mounted on a follower which is slidably mounted in one of the guide tracks. The follower is proportioned to pass freely along the return section. Drag is applied to the follower as it is driven along the drive section to resist the movement of the follower. A support frame is provided for supporting the user in a forwardly inclined semi-prone position which corresponds to the position assumed by a skater when accelerating forwardly.

Miller et al., U.S. Pat. No. 5,284,460 describes an apparatus and method for skate training exercise comprising arms of relatively long length pivotally mounted on a frame. The user's foot is secured in a stirrup on the arm opposite the pivot point. A resistance means is provided to provide resistance as the user pushes his foot away from the body along an arcuate path defined by the arm in simulated skating stroke. A return means is provided to assist the user in returning his foot along the arcuate path after predetermined angle is traversed. Various resistant means include electromagnetic, fly wheel-fan and weight stack.

Gordon, U.S. Pat. No. 5,342,264 describes an aerobic exercise device which provides for a smooth, natural, orbital continuous motion of the user's feet. This device can be used for walking, running, jogging or stair-stepping exercises. Upper body workout devices can be provided with the aerobic exercise device such that a total body workout can be had. The device includes two parallel tracks with platforms. The platforms reciprocate along the tracks. A device is provided in each track for returning the platforms to the home position. As a user operates the device, he or she will push the platforms rearwardly. When the user's foot reaches the end of his or her stride, the user can then lift their foot in a natural motion. The device will return the platform to the home position. As the platform is returning to the home position, it will first travel in a forward direction and then switch to a rearward direction. This rearward movement will enable comfortable planting of the user's foot as it reengages the platform. The device can be easily accommodated to any desired workout level or to many different sized users.

Green et al., U.S. Pat. No. 5,391,130 describes an exercise apparatus used for leg exercises, and particularly for exercising the muscles used in ice skating. The apparatus has a frame with two four bar linkages arranged side by side. Each linkage carries a foot pad. A resistance unit is attached to each linkage to resist movement of the linkage in both directions. The resistance unit is preferably a double acting hydraulic cylinder connected to variable flow control valves to vary the resistance to linkage movement.

Harrigan, U.S. Pat. No. 5,451,194 describes a roller skate exercise device which consists of a platform having a top surface to support a pair of roller skates worn by a person. Components are for permitting the roller skates to slide in opposed reciprocating motions on the top surface of the platform, so as to simulate cross country skiing.

Little, U.S. Pat. No. 5,520,598 describes a combination leg exercise device, including: a base member; two, elongate, parallel plates attached to rotating apparatus mounted on the base member; and support apparatus disposed at distal ends of the plates to accommodate thereon selected weights; such that a person standing on the plates, with a foot disposed over each of the rotating apparatus, moves the weights between a first, lowered position and a second, elevated position by alternatingly flexing and relaxing muscles in the person's lower legs; the device further including: two track assemblies extending horizontally from the base member; and the track assemblies including thereon two wheeled platforms; such that a person standing with a foot on each of the platforms, slides the platforms back and forth along the track assemblies by alternatingly flexing and relaxing inner and outer muscles in the person's upper legs.

Alvarez et al, U.S. Pat. No. 5,692,995 describes an exercise machine that simulates the movements made during snow skiing and has a pair of foot support arms mounted for limited rotational movement about separate axes of rotation so that foot support portions of the foot support arms move simultaneously both vertically and horizontally, coordinates simultaneous movement of both foot support arms through a gear train coupling the foot support arms. In addition, foot support treads which support the feet of a user of the machine are resiliently mounted to the foot support arms to allow angling of the foot support treads to simulate a feeling of edging of skis.

Miller et al., U.S. Pat. No. 5,718,658 describes an apparatus and method for skate training exercise comprising arms of relatively long length pivotally mounted on a frame. The user's foot is secured in a stirrup on the arm opposite the pivot point. A resistance means is provided to provide resistance as the user pushes his foot away from the body along an arcuate path defined by the arm in simulated skating stroke. A return means is provided to assist the user in returning his foot along the arcuate path after predetermined angle is traversed. Various resistant means include electromagnetic, fly wheel-fan and weight stack.

U.S. Pat. No. 6,234,935 to Chu describes a skating exercise machine which is adapted to simulate skating movement by the use of a pair of cantilevered supports geared so as to move in an arcuate plane. The exercise apparatus of both Chu and Miller above ('658), however, suffer the disadvantage in that in their operation, the user's feet are maintained in a generally forward oriented position while moving about a lateral horizontal arc. In contrast, in roller blading or ice skating, an individual typically performs a skating stride whereby the position of each foot during each stride moves so as to turn outwardly, to provide an increased thrust force.

U.S. Pat. No. 6,514,180 relates to an apparatus includes a frame having left and right pedal guides, left and right pedals moveably coupled to the left and right pedal guides, and a pedal control device. The pedal control device is coupled to the left and right pedals such that as one of the left or right pedals is moved along its pedal guide, the other pedal is moved in an opposite direction along its pedal guide, and both the left and right pedals rotate in a first rotational direction. As the pedals are moved back along their respective pedal guides in opposite directions, the pedal control device simultaneously rotates the pedals in a second rotational direction.

Lastly, U.S. Patent Application Publication No.: 2002/0042329 to Nizamuddin describes an exercise apparatus used to simulate skating or roller blading movement in a user includes a pair of sleds or shuttles which include a pedal adapted to support the foot of a user standing thereon. The shuttles are movable along a respective guide assembly consisting of one or more rails which curve away from each other extending from proximate forwardmost ends, outwardly and rearwardly. However, the rail assemblies are provided in a substantially mirror arrangement and curve downwardly from their respective forwardmost ends to a lowermost distal portion.

To summarize, current, conventional skate training devices suffer the disadvantage in that they are poorly suited to mimic, train and condition muscles used by skaters in the true leg motions necessary for enhanced skating performance. In particular, as prior art skating devices are adapted to provide lateral movement substantially in a downward or horizontal plane, conventional skating exercise apparatus fail to account for the change in leg and foot position experienced by a skater during the forward curvature motion of each leg. Furthermore, conventional skating exercise devices which operate to move the user's leg only in a downward plane as the user's leg moves outwardly, may result in the exercise of muscles groups not actually involved in the skating motion.

Thus, in general, the prior art teaches physical training machines for a limited range of muscle development. Furthermore, the prior art does not teach a simple training machine capable of reproducing true ice skating motions. Consequently, there is a significant need for the development of an ice skating training apparatus which simultes or replicates the true motion of skating, while also providing strength and endurance training for all leg muscles involved in ice skating.

SUMMARY OF THE INVENTION

It is an object of the present invention to provide an ice skating exercise apparatus which, in use, permits strengthening and conditioning to a wide variety of leg muscles, including one or more of the biceps femoris muscle, the gracilis muscle, the sartorius muscle, the gastronemius muscle vastus intermedius, vastus lateralis, vastus medialis, iliopsoas, tibialis anterior, gluteus maxinmus, semimembranosus, semitendinosus and/or the soleus muscle.

Another object of the invention is to provide an ice skating exercise apparatus which is designed to simulate or replicate the an athelete's natural ice skating movement, in both forward and backward leg motions for skating in a forward direction.

The present invention relates to an ice skating exercise apparatus comprising a horizontal platform having left and right defined curvature stride paths, with left and right pedal assemblies moveably coupled to the left and right defined curvature stride paths, respectively. The defined curvature stride paths are provided in a substantially symmetrical and mirror-image arrangement to one another, each of which curves outwardly from their respective forwardmost ends and curves inwardly from their respective rearmost ends. Each pedal assembly is comprised of a footpad for the positioning of the user's feet, a pivot rod allowing for movement of the feet about a 90 degree inwardly axis and a block guide for maintaining the position of the respective pedal assemblies within their respective stride paths. A resistance mechanism is also provided to enable the user to vary the resistance to which the peddle assemblies move along the defined stride paths, for example, to provide a workout of increased or decreased difficulty depending on whether the user's interest in strenghthening or conditioning the leg muscles.

Thus, the present invention answers the significant need of an ice skating apparatus which provides for proper exercise of muscles involved in the true skating motion by providing a simulation of that motion. In addition, the apparatus can be operated under varying degrees of resistance, thereby allowing both strength and endurance muscle training.

Other features and advantages of the present invention will become apparent from the following more detailed description, taken in conjunction with the accopnaying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
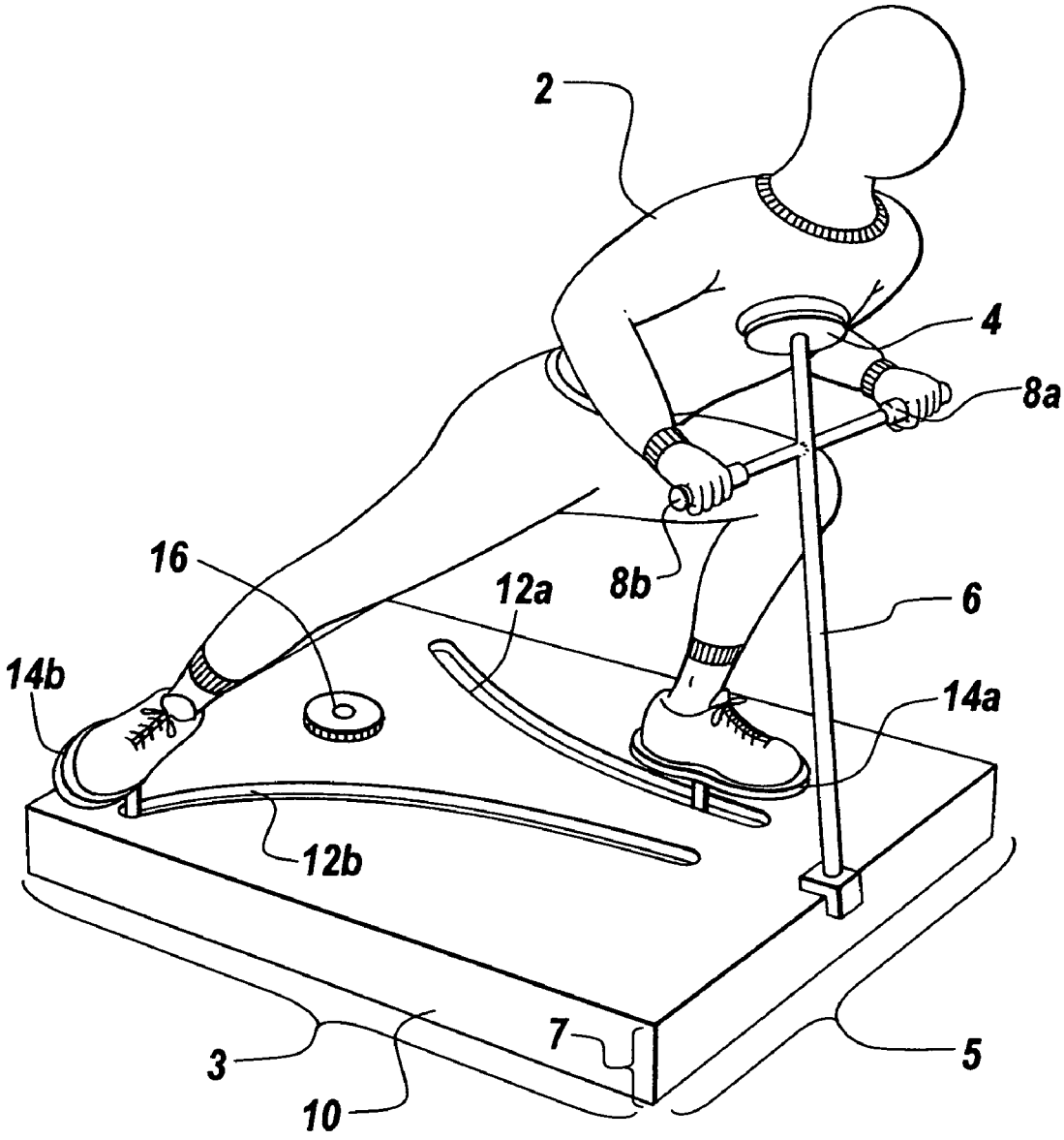
FIG. 1 is a diagramatic representation of a preferred embodiment of the present invention, illustrating the invention in use.

FIG. 1 illustrates an exercise apparatus adapted to provide a user (2) with an exercise workout which simulates an athlete's movement when ice skating. The apparatus is shown as a free standing unit and includes a horizontal platform (10), defined curvature stride paths (12*a*, 12*b*), respective pedal assemblies for the right and left feet (14*a*, 14*b*), a variable resistance mechanism (16), a handle assembly (8*a*, 8*b*) and a chest support (4).

Horizontal Platform:

The horizontal platform of the present invention can be constructed in varying dimensions and of a number of materials. The primary purpose of the horizontal platform is to provide vertical support and areas of space for placement the defined curvature stride paths and movement of the respective pedal assemblies. Consequently, the dimensions of the platform must allow for defined curvature stride paths with lengths at least as long as the length of a user's extended leg. In a preferred embodiment of the present invention, the dimensions of the horizontal platform can be 3 to 5 feet in length (FIG. 1, 3), 3 to 4 feet in width (FIG. 1, 5) and 4 to 8 inched in depth (FIG. 1, 7). Any one of a number of materials can be used in the construction of the platform, including but not limited to wood, metals, plastic. The primary characteristic criteria for the construction material is that it be of non-deforming strength in providing support for the weight and operation of a user. In a preferred embodiment, the areas of the platform which encounter moveable parts such as the block guide and the pivot rod will be constructed of or lined with a material which does not create a significant amount of friction between the platform and the moveable parts. Lastly, the platform should be horizontal in position to the ground or floor, so as to simulate the position of skating ice relative to a skater.

Figure 2:
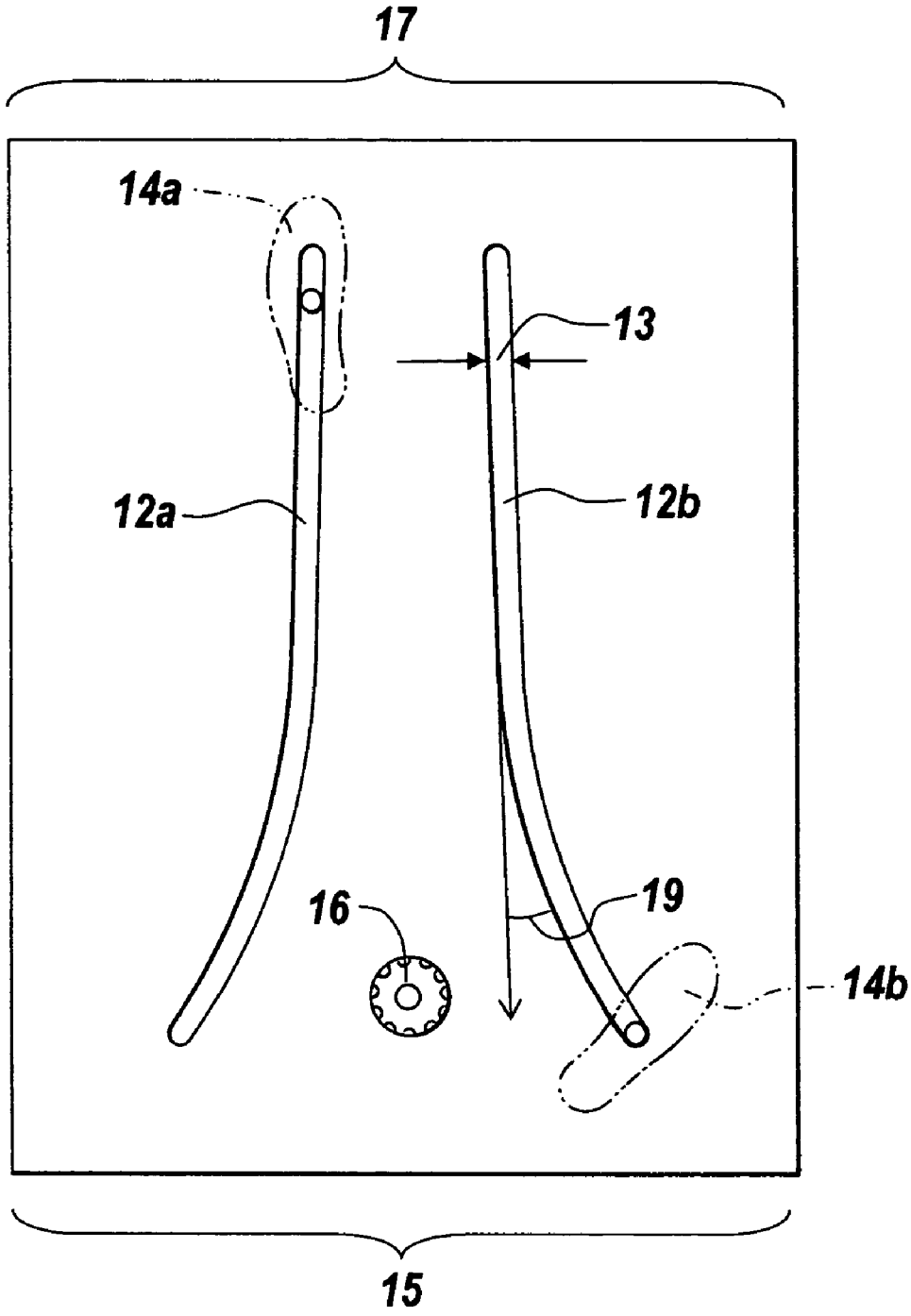
FIG. 2 is a diagramatic representation of the invention's platform illustrating the top-face of the platform and defined curvature stride paths and their respective positioning.

Defined Curvature Stride Paths:

FIG. 2 illustrates the curvatures of the respective defined curvature stride paths and their relative positioning to one another. First, the width of the open space within the stride path should allow for the movement of the pedal assemblies, with or without resistance. In a preferred embodiment of the invention, the open space within the area of the stride path is 1 to 3 inches in width (13). As mentioned before, the length of the stride paths should be as long as the length of a user's leg upon full extension. In a preferred embodiment of the invention, the overall length of the stride path from the forwardmost end (17) to the rearmost end can be between 3 and 5 feet in length. Needless to say, both the length of each stride and the speed of foot motion may be varied at the discretion of the user.

The defined curvature stride paths are qualified as being "defined" in the regard that they are fixed within the confines of the horizontal platform with a specific curvature configuration. The length, width and curvature of the stride paths can vary from one embodiment of the invention to another embodiment. However, for each individual unit (i.e., each separate apparatus) the stride paths will be constant and unchangeable.

The curvature of the stride path is of significant importance with regard to simulating the true motion of ice skating. The defined curvature stride paths are provided in a substantially symmetrical, horizontal and mirror-image arrangement to one another, each of which curves outwardly from their respective forwardmost ends (17) and curves inwardly from their respective rearmost ends (15), as illustrated in FIG. 2. The degree of curvature from the forwardmost end toward the rearmost end (19) can vary from slight (e.g., two degrees variation from the stride path extended without a curvature, straight toward the rearmost end) to extreme (e.g., sixty degrees variation from the stride path extended without a curvature, straight toward the rearmost end). In addition, the distance between the respective stride paths can vary, but in a preferred embodiment, about 1 to 3 feet.

The defined curvature stride paths are formed within the confines of the horizontal platform, and as a consequence, are themselves horizontal in orientation to the ground or flooring. The horizontal orientation is preferred in the present invention in the regard that it simulates the skater's position relative to a horizontal platform of ice.

Figure 5:
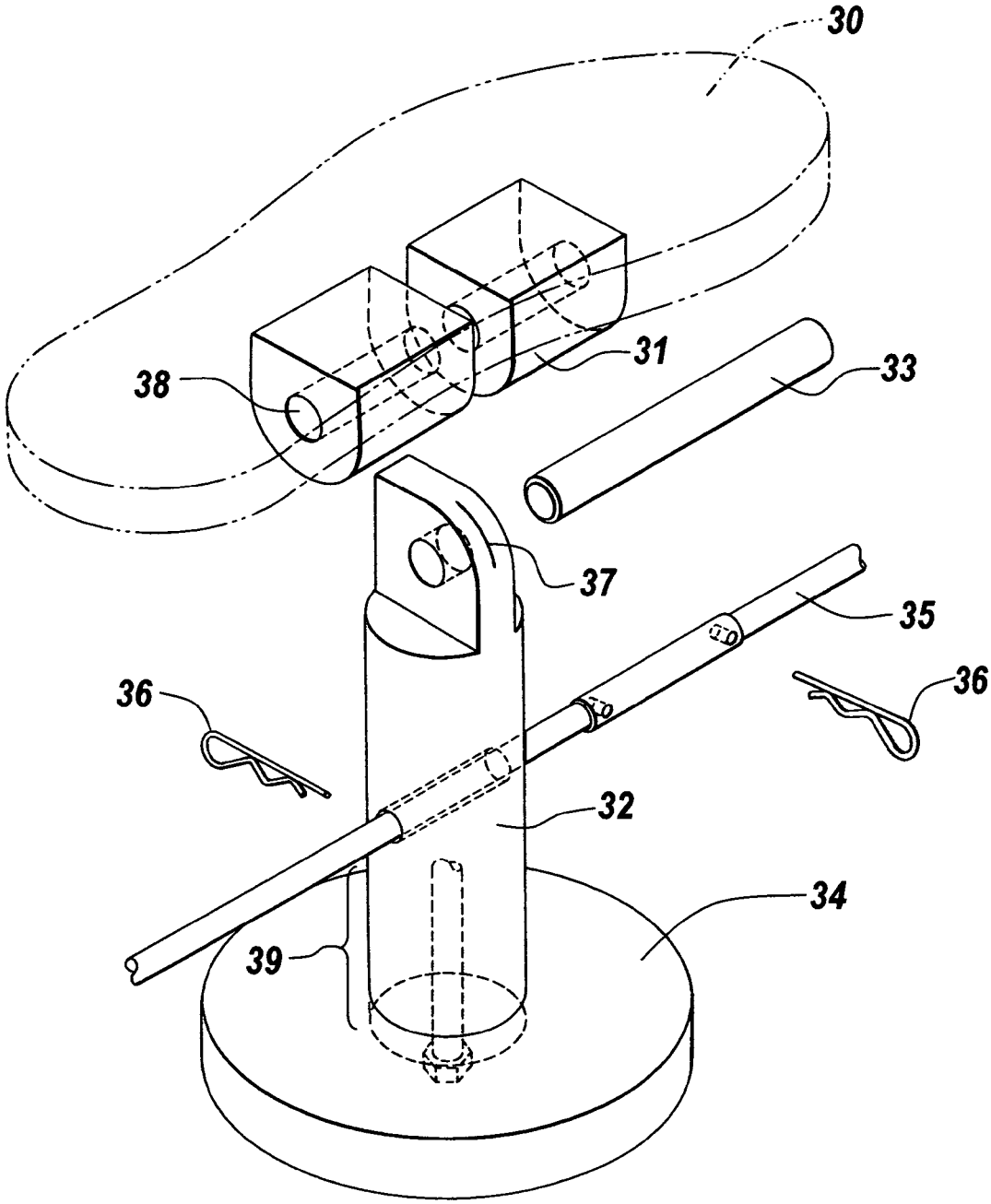
FIG. 5 is a diagramatic representation of the pedal assembly of the present invention, illustrating the footpad, the pivot rod and the block guide.
Figure 6:
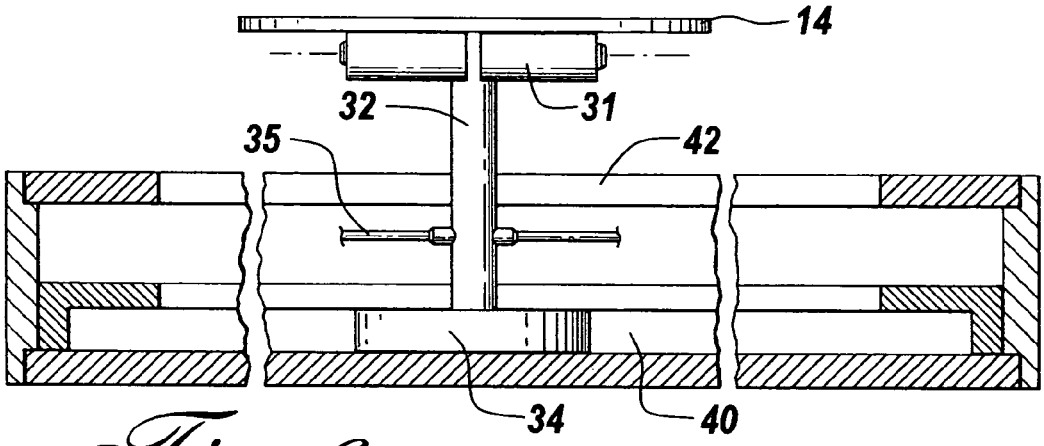
FIG. 6 is a diagramatic representation of the pedal assembly moveably coupled within a defined curvature stride path of the invention platform.
Figure 7:
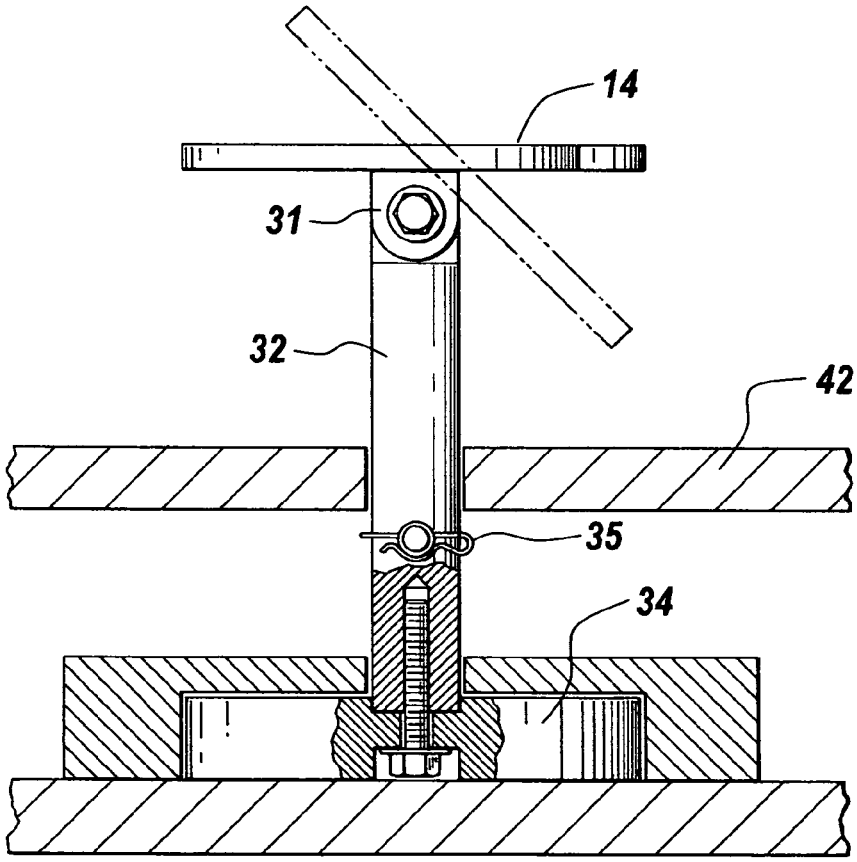
FIG. 7 is a diagramatic representation of the pedal assembly moveably coupled within a defined curvature stride path of the invention platform, illustrating the inwardly movement of the left footpad about a 90 degree axis on the pivot rod.

Pedal Assembly:

A pedal assembly of the present invention is depicted and illustrated in FIG. 5 herein. The footpad (30) sits on and is coupled to the pivot rod (32). The footpad and pivot rod are coupled mechanically by a fasten-pin device. The top section of the pivot rod (37) allows for rotation of the footpad inwardly (in the illustratios of FIGS. 5 and 7, for the left foot) about a 90 degree axis. The fasten-pin devise is comprised of an attachment lodge with a circular opening (38) throughout the center of the lodge and a locking pin (33), which when engaged in the circular opening acts to secure the footpad to the pivot rod.

In addition, the pivot rod extends downward and is coupled mechanically to the block guide (34) which sits within an underlayment channel of the horizontal platform. The underlayment channel (40) is an enclosed track which runs underneath and parallel to the defined circular stride path. The function of the block guide is to maitain the position of the entire pedal assembly within the stride path and to allow for the low friction movement of the pedal assembly. The block guide is preferably constructed of low friction material (e.g., plastic). Alternatively, the bottom of the block guide can be modified to contain a number of ball bearings or roller balls, permiting easy movement of the block guide along the suface of the underlayment channel. Materials for constructing the block guide and allowing its movement with the pedal assembly as a whole are well known in the art.

Optionally, the pivot rod also can be comprised of a stabilizing under-rod (35) which provides underlying support beneath the top-face of the horizontal platform for added steadiness and constancy of movement for the pedal assembly, as a whole.

Lastly, the pedal assembly provides for an area along the shaft of the pivot rod (39) whereby the elastomeric strap of the variable resistance mechanism partially surrounds the shaft to impart increased or decreased resistance to movement of the pedal assembly.

Figure 4:
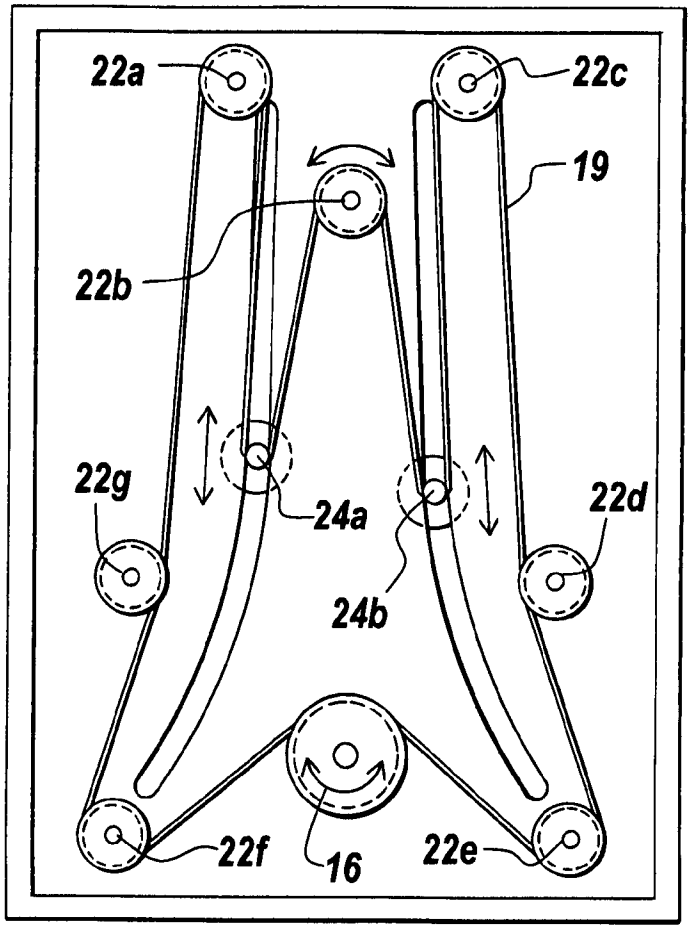
FIG. 4 is a diagramatic representation of a second embodiment of the variable resistance mechanism of the present invention with an alternative arrangement of elements.
Figure 3:
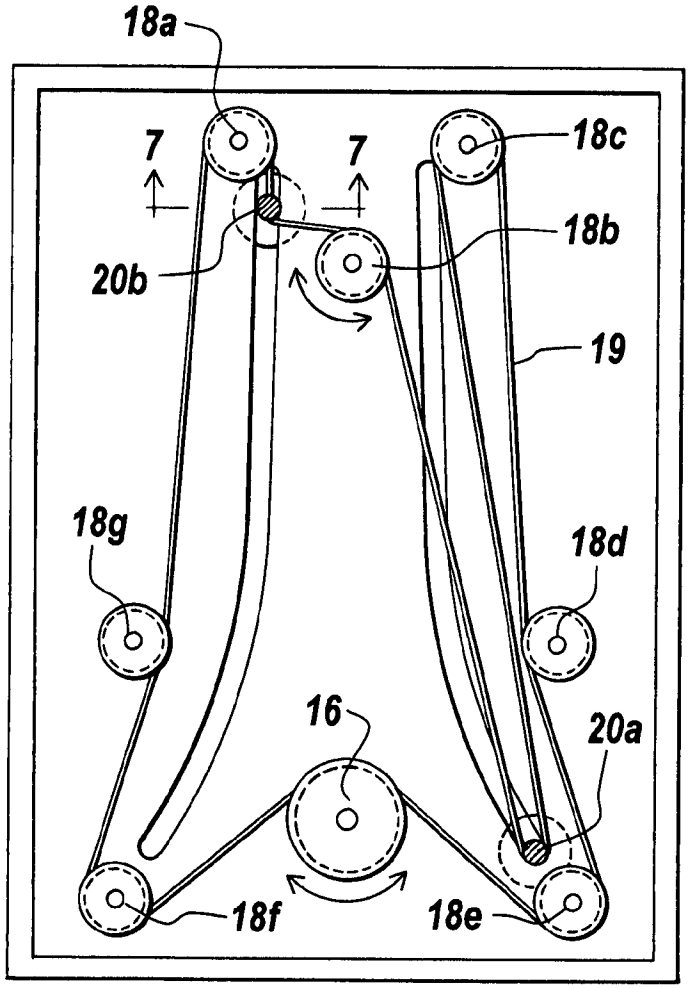
FIG. 3 is a diagramatic representation of one embodiment of the variable resistance mechanism of the present invention, illustrating the arrangement of the pulleys, the fly wheel tension gear and the elastomeric strap.

Variable Resistance Mechanism:

The variable resistance mechanism is depicted and illustrated in FIGS. 3 and 4. Each Figure represents an alternate arrangement of the elements involved in the mechanism's operation. Wherein the elements comprise aseries of pulleys (18*a* thru 18*g* of FIG. 3 and 22*a* thru 22*g* of FIG. 4), an elastomeric strap (19), a fly-wheel tension gear (16) and the respective pedal assemblies (20*a*, 20*b* in FIG. 3 and 24*a*, 24*b* in FIG. 4).

The elastomeric strap is positioned about the arrangement of pulleys, the pedal assemblies and the fly-wheel tension gear as illustrated in FIGS. 3 and 4. Rotation of the fly-wheel tension gear acts to increase or decrease the overall length of the elastomeric strap, thereby decreasing or increasing resistance, repectively.

While the preferred embodiment of the invention discloses the tensioning mechanism as comprising a flywheel (16) and adjustable tensioning strap (19), it is to be appreciated that other tensioning devices could also be used, including without restriction, weights or pressure stacks, fan resistant mechanisms and electromagnetic resistance mechanisms.

Hand Assembly and Chest Support:

The handle assembly includes a pair of fixed laterally extending grips 8*a*, 8*b* secured to an upright support (6). The grips (8*a*, 8*b*) extend laterally outward from the central axis. It is to be appreciated that the configuration of the grips (8*a*, 8*b*) is selected so that they may be comfortably grasped by the user (2) to assist in his or her balancing on the exercise apparatus standing in the forward facing position shown in FIG. 1 during its use.

Lastly, a chest support (4) is mounted at the upper end of the upright support (6). In operation, a user would lean onto the chest support for further maintenance of his or her balance while using the apparatus.

Operation in Use:

In operation, the user (2) stands on the apparatus grasping the handle grips (8*a*, 8*b*) with his or her feet facing forward and resting on the footpads of the pedal assemblies (14*a*, 14*b*) in the manner shown in FIG. 1. Each foot is secured to the footpad, by fixtures (not shown). Alternate means of securing the user's feet are available and known in the art.

To initiate the exercise workout, the user (2) pushes rearwardly and outwardly with the right foot on the right pedal assembly (14*b*) to start skating movement. As the user's foot moves away from the forwardmost end (FIGS. 2, 17) of the platform, the pedal assembly travels along the curvature stride path (12*b*) towards its distal or rearmost end (FIGS. 2, 15) of the platform. As the pedal assembly moves away from the start position, its upper surface, the footpad (FIGS. 5, 30) begins to tilt inwardly, pivoting about a 90 degree axis, as it travels towards the rearmost end of the platform and the stride path (15). As a result, the user's leg is rotated so that the toes of the user face outwardly with the leg extended rearwardly, without placing significant rotational forces on the user's ankle. As the pedal assembly moves towards the rearmost end of the curvature stride path, the elastomeric strap (19) imparts a rotational force on the pully arrangement.

Following movement of the pedal assembly (14*b*) to the rearmost end of the stride path, the user (2) shifts his weight onto the left foot to move the pedal assembly (14*a*) along the stride path toward the rearmost end. It is to be appreciated that the pedal assembly (14*a*) for the left foot travels along the stride path (12*a*) in the mirror manner to that of pedal assembly for the right foot (14*b*).

The skating motion is thus simulated by the apparatus with the user sequentially shifting his or her weight between the pedal assemblies (14*a*, 14*b*). In addition to more closely simulating a true skating motion, the rotational movement of the footpads (30) as they move along the stride paths (12*a*, 12*b*) optimizes the exercise of the user's leg muscle groups, as the user shifts his or her weight between the pedal assemblies (14*a*, 14*b*).

The teachings of U.S. Pat. Nos. 4,340,214; 4,781,372; 4,869,496; 4,915,373; 5,284,460; 5,342,264; 5,391,130; 5,451,194; 5,520,598; 5,692,995; 5,718,658; 6,234,935;

6,514,180; and U.S. Patent Application No. 2002/0042329 are hereby incorprated by reference in the present application, in their entirety.

Although the detailed description descibes and illustrates a preferred apparatus, the invention is not so limited. Many variations and modifications will be evident to persons skilled in the art.

I claim:

1. An exercise apparatus for simulating ice skating movements in a user, the apparatus comprising, a) an elongated horizontal platform having a top surface, a forward end, a rearward end and a longitudinal axis that divides the platform in half;

b) two defined curvature guide paths disposed on the top surface;

c) two pedal assemblies moveably coupled to the guide paths; and d) a variable resistance mechanism wherein the defined curvature guide paths are non-looped and are in a substantially symmetrical, horizontal and mirror-image arrangement to one another, each of which curves outwardly from its respective forwardmost end and curves inwardly from its rearmost end such that each curve is convex relative to the longitudinal axis;

e) a chest support mounted to the platform near the forward end.

2. An exercise apparatus of claim 1, wherein the apparatus further comprises a hand assembly.

3. An exercise apparatus of claim 1 wherein each pedal assembly comprises:

a) a footpad;

b) a pivot rod; and c) a block guide.

4. A pedal assembly of claim 3, wherein the pivot rod allows inward rotation about a 90 degree axis.

5. An exercise apparatus of claim 1, wherein the variable resistance mechanism mounted within the horizontal platform comprises:

a) a fly wheel tension gear;

b) a series of pullys arranged along and under the defined curvature guide paths; and c) a tension bearing elastomeric strap.

6. An exercise apparatus of claim 1, wherein the variable resistance mechanism can increase or decrease resistance.

* * * * *